United States Patent [19]

Frühbuss

[11] 4,024,022

[45] May 17, 1977

[54] METHOD OF INHIBITING DUST FORMATION WHEN FEEDING COAL INTO COKING CHAMBERS

[75] Inventor: Heinrich Frühbuss, Essen, Germany

[73] Assignees: Bergwerksverband GmbH; Didier Engineering GmbH, both of Essen, Germany

[22] Filed: Dec. 2, 1975

[21] Appl. No.: 636,557

[30] Foreign Application Priority Data

Dec. 5, 1974 Germany ..... 2457528

[52] U.S. Cl. ..... 201/23; 201/20; 201/21

[51] Int. Cl.[2] ..... C10B 53/00; C10B 57/04

[58] Field of Search ..... 201/21, 23, 41, 20, 201/9, 25

[56] References Cited

UNITED STATES PATENTS

| | | | |
|---|---|---|---|
| 1,875,287 | 8/1932 | Weber | 201/21 X |
| 1,920,951 | 8/1933 | Ramsburg | 201/23 |
| 2,336,154 | 12/1943 | Wolf | 201/20 X |
| 2,378,420 | 6/1945 | Lohr et al. | 201/23 |
| 2,591,496 | 4/1952 | Berl | 201/20 |
| 3,146,183 | 8/1964 | Reed et al. | 201/23 |
| 3,151,041 | 9/1964 | Heinze et al. | 201/6 |

*Primary Examiner*—Joseph Scovronek
*Attorney, Agent, or Firm*—Michael J. Striker

[57] ABSTRACT

One of the problems encountered when feeding dry or preheated coal into coking chambers resides in that dust is generated. This dust is indesirable since it can form deposits which are difficult to remove. A method of inhibiting the dust formation when coal is fed into coking chambers is disclosed. The method involves contacting the coal with used motor oil prior to the introduction of the coal into the coking chambers. The utilization of used motor oil for inhibiting dust formation provides the advantages of economy and reduction of environmental pollution.

8 Claims, 1 Drawing Figure

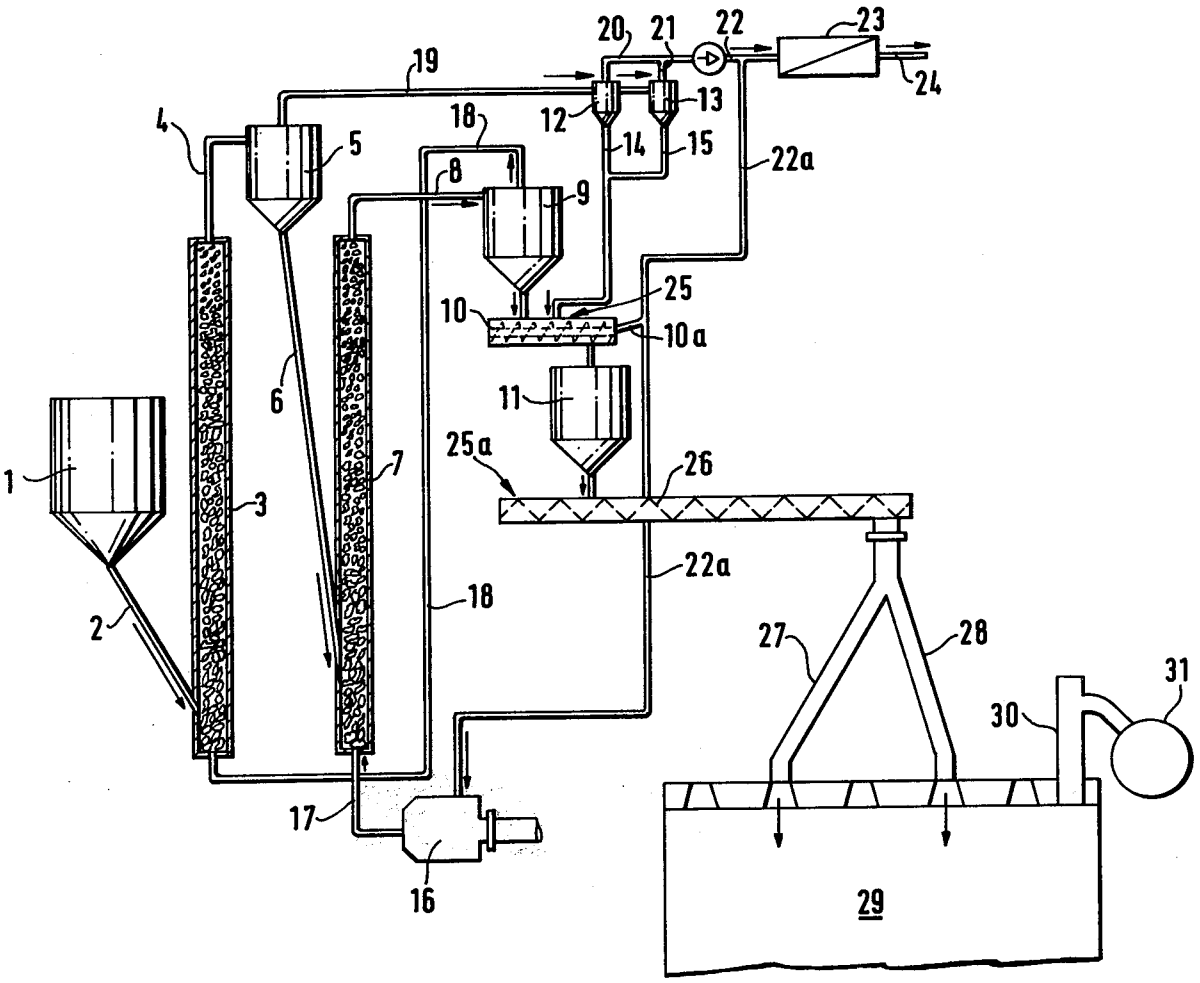
1
2
3
4
5
6
7
8
9
10
10a
11
12
13
14
15
16
17
18
18
19
20
21
22
22a
22a
23
24
25
25a
26
27
28
29
30
31

METHOD OF INHIBITING DUST FORMATION WHEN FEEDING COAL INTO COKING CHAMBERS

BACKGROUND OF THE INVENTION

The invention relates generally to the coking of coal.

The coking of dry or preheated coal such as, for instance, coal which has been heated to the temperature range of 150° to 250° C prior to coking, provides the advantage that savings in high-priced fuel may be realized during the coking process. The reason is that lower priced fuels may be used for the preheating operation than for the coking operation. Moreover, the use of preheated coking coal permits coke of higher quality to be produced. In particular, the coke produced from coal which has been preheated has a larger particle size and a greater resistance to abrasion than the coke produced from coal which has not been preheated. Consequently, a preheating operation makes it possible to use coal of poorer coking quality than would otherwise be required during a coke production process.

There is, however, a disadvantageous aspect associated with the introduction of dry, preheated coal into the coke ovens and this resides in the marked generation of coal dust which occurs interiorly of the ovens. The dust escapes from the ovens into the collecting means and, in the latter, leads to the formation of deposits or blockages which are difficult to remove.

It has already been proposed to add 0.5 to 3 percent by weight of residual oils having a Baume density of 6°–25°, or of residual oils in admixture with pitch, to the preheated coal, the purpose being to reduce the danger of ignition and explosion. The action of these additions is, however, unreliable since a uniform distribution of the residual oils over the coal, particularly when the oils are mixed with pitch, is extremely difficult to achieve. The reason for this resides in that the additions outlined above have a relatively poor wetting effect on the hot coal. Accordingly, these additions have little effect as binding agents for the coal dust and, if any such effect is to be achieved, it is necessary to provide special mixers.

SUMMARY OF THE INVENTION

One object of the invention is to provide a method which enables dust generation during feeding of coal into a coke oven to be effectively inhibited without the use of special equipment.

Another object of the invention is to provide a method which enables dust generation during feeding of coal into a coke oven to be effectively inhibited in an economical manner.

An additional object of the invention is to provide a method which enables dust generation during feeding of coal into a coke oven to be effectively inhibited and which, concomitantly, leads to lessened environmental pollution.

These objects, as well as others which will become apparent as the description proceeds, are achieved in accordance with the invention. According to one aspect of the invention, there is provided a method of inhibiting dust formation when coal is introduced into a coking chamber wherein the coal is contacted with used motor oil prior to the introduction of the coal into the coking chamber.

The novel features which are considered as characteristic for the invention are set forth in particular in the appended claims. The invention itself, however, both as to its construction and its method of operation, together with additional objects and advangages thereof, will be best understood from the following description of specific embodiments when read in connection with the accompanying drawing.

BRIEF DESCRIPTION OF THE DRAWING

The single FIGURE represents schematically one form of an arrangement which may be used for carrying out a method according to the invention.

DESCRIPTION OF THE PREFERRED EMBODIMENTS

It has now been found that an outstanding binding of coal dust in dry or preheated coal and, consequently, a particularly effective reduction in the dust discharged into the collecting means (called "carry over"), during the feeding of the coal into coke ovens is achieved in that the coal is wetted with the used oil obtained from motor vehicles. All grades of motor oil may be used. Preferably, the coal is wetted with 0.5 to 5 percent by weight of the used motor vehicle oil. By virtue of their high fluidity, that is, their relatively low viscosity, and the additives contained therein, these oils rapidly and uniformly distribute themselves over the coal which is wetted therewith. Although it is possible to utilize a special mixing aggregate for the wetting of the coal with the oil, the use of such an aggregate is unnecessary. It is sufficient, for instance, when the coal which is on its way to the coke ovens is sprayed with the used motor oil.

The good ability of the used oil to distribute itself over the coal is explained, in particular, by its high fluidity. The density of the used oil is equal to approximately 1.0 gram per cubic centimeter or less.

If desired, the used oil may initially, that is, prior to contact with the coal, be freed from its low boiling point constituents by skimming. The low boiling point components, in turn, represent the only portion of the used oil which may readily be put to other uses without great expense. It is particularly recommended to distill off the components which boil or volatize at temperatures of up to 150° C.

The fear that the used motor oils, which are generally diluted with fuels, could cause ignitions or outright explosions when sprayed onto or mixed with the hot coal have surprisingly not been confirmed in practice.

Since used motor oils are available in large quantities, and mostly without cost, and since their disposition is increasingly becoming a problem, the invention also provides the advantage of making it possible to dispose of these oils without great expenditure and without damage to the environment.

Since, as has been further found, the addition of the used oil to the coal does not have an adverse effect on the quality of the coke produced, it is possible to add relatively large quantities of the used oil to the hot coal without any hesitation. Thus, a satisfactory binding of the coal dust may be assured.

In order to further increase the ability of the used oil to bind the coal dust particles, it is possible to add substances which exhibit or possess an adhesive action to the used oil. Exemplary of such substances is 20 to 70 percent waste sulfite liquor. The substances exhibiting an adhesive action are favorably added to the used oil in amounts of up to 50 percent by weight.

It is advantageous to spray the used oil into the transporting devices such as, for instance, screw conveyors and scraper conveyors, which transport the dry or preheated coal to the filling wagons or filling connections. The reason is that a mechanical mixing of the oil with the coal necessarily occurs in these devices. Moreover, a favorable lubricating effect, which is a welcome side effect of the used oil addition, is also achieved in the transporting devices.

Since generally, during the heating of the coal, large or coarse coal particles are obtained separately from and in addition to coal which is virtually in dust-like form and since, in particular, it is the latter which causes the dangerous "carry over," it is also advantageous to spray the used oil exclusively onto the practically dust-like coal.

The invention will now be further described with reference to the single FIGURE.

Coking coal which, in general, has a particle size of 0.06 to 6 millimeters, is obtained from a supply container 1. From the container 1, the coal is fed into the bottom of a first pneumatic conveying dryer 3 via a conduit 2. The coal travels upwardly through the dryer 3 and, concomitantly, is subjected to a first drying and preheating stage.

The coal leaves the dryer 3 through a conduit 4 and, from the latter, is introduced into a cyclone 5 where it is removed from the gas which entrained it and carried it through the dryer 3. From the cyclone 5, the coal slides to the bottom of a second pneumatic conveying dryer 7 via a conduit 6. The coal travels upwardly through the dryer 7 and, simultaneously, is subjected to a second drying and preheating stage.

The coal leaves the dryer 7 through the top thereof and enters a conduit 8 from which it is introduced into a cyclone 9. In the cyclone 9, the coal is removed from the gas which entrained it and carried it through the dryer 7. Since the fine portions of the coal are carried out of the cyclone 5 as coal dust together with the combustion gases which carry the coal through the dryer 3, it is essentially only the coarser portions of the preheated coal which are collected in the cyclone 9. The coarser portions of the coal are forwarded to a storage and feed container 11 via a screw conveyor 10.

The hot combustion gases in the cyclone 5 containing the fine portions of the coal are withdrawn from the cyclone 5 via a conduit 19. The thus-withdrawn combustion gases are then admitted into cyclones 12 and 13 wherein they are freed from the fine portions of the coal, that is, the coal dust. The thus-recovered fine coal is forwarded to the screw conveyor 10 through conduits 14 and 15.

The heating and conveying of the coking coal is effected with gases obtained from a combustion chamber 16. The hot gases produced therein, for instance, by the combustion of oil, initially flow through a conduit 17 into the dryer 7. After passing through the dryer 7, the hot combustion gases then pass through the conduit 8 into the cyclone 9 together with the coal which has been preheated in the dryer 7. From the cyclone 9, the hot combustion gases flow through a conduit 18 into the dryer 3.

In the dryer 3, the hot combustion gases convey the initially moist coal to and through the conduit 4 and into the cyclone 5. From the cyclone 5, the hot gases flow through the conduit 19 into the cyclones 12 and 13 mentioned earlier. The hot gases leave the cyclones 12 and 13 via conduits 20 and 21 and thereafter are conveyed into a conduit 22. The conduit 22 opens into a wet washer 23 and all or a portion of the hot gases flowing through the conduit 22 may enter the washer 23. The gases entering the washer 23 leave the apparatus as purified gases via a conduit 24.

A conduit **22*a* branches off from the conduit 22 and leads to the combustion chamber 16 and all or a portion, as desired, of the hot, water-containing gases flowing through the conduit 22 may be branched off through the conduit 22*a*. The hot gases flowing through the conduit 22 contain water since they have been used for drying of the initially moist coal. The hot, water-containing gases (vapors) withdrawn from the conduit 22 via the conduit 22*a* are returned to the combustion chamber 16**.

Prior to entry of the coal into the storage and feed container 11, the preheated coal is sprayed with used motor oil at the location indicated by the arrow marked 25. Particularly favorably, the preheated coal is sprayed with used motor oil in the screw conveyor 10 at or adjacent the inlet provided for coal of dust-like form. The gases released may escape from the screw conveyor 10 into the vapor line **22*a* via a conduit 10*a***.

When the coal stored in the container 11 is to be coked, the coal slides out of the container 11 into a chain conveyor 26. The conveyor 26 conveys the coal to conduits 27 and 28 through which the coal is fed into a coke oven 29. It is possible to spray used motor oil into the conveyor 26 also as indicated by the arrow **25*a***.

An uptake 30 is connected to the coke oven 29. The reference numeral 31 identifies a collecting means which the respective carry over is determined.

The following Example is intended to further illustrate the invention and is not to be considered as limiting the same in any manner:

EXAMPLE

A mixture of bituminous coals obtained from the Alpheus and Corbin mines of the United States has a volatile components content of 28 percent. The coal is heated to 190° C by pneumatic conveying techniques and is then charged into a mixing screw such as the screw conveyor 10. Upon entering the screw or conveyor, the coal is sprayed with 2 percent by weight of used motor oil. The sprayed coal leaves the conveyor or screw and enters an intermediate or feed container such as the container 11. From the container, the sprayed coal travels onto a chain conveyor such as the conveyor 26 having a length of 70 meters. The conveyor opens into a charging hopper. From the hopper, the sprayed coal is permitted to slide into a coke oven such as the oven 29 via conduits which are connected to the filling holes of the oven. After the filling operation, the carry over is determined in the collecting means. The carry over is found to be 6 kilograms of coal dust per ton of coal charged.

Without the addition of used motor oil, the carry over amounted to 18 kilograms of coal dust per ton of coal charged.

It will be understood that each of the elements described above, or two or more together, may also find a useful application in other types of operations, differing from the types described above.

While the invention has been illustrated and described as embodied in a method of inhibiting dust formation when feeding coal into coking chambers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of inhibiting dust formation when feeding coal into a coking chamber, comprising preheating the coal to temperatures between about 150° and 250° C.; and contacting said preheated coal, prior to the introduction of the coal into the coking chamber, with about 0.5 to 5 percent by weight of used motor oil recovered from a motor vehicle.

2. The method of claim 1, wherein the coal is dried prior to contact with the oil.

3. The method of claim 1, wherein coal dust is generated during the preheating and the oil is added to the coal dust.

4. The method of claim 1, wherein the oil contains low boiling point constituents and the latter are at least partially removed from the oil prior to contacting the coal with the oil.

5. The method of claim 1, wherein the coal is admitted into a conveying device and the oil is sprayed into the conveying device.

6. The method of claim 1, wherein the oil is mixed with up to about 50 percent by weight of a substance capable of binding coal dust.

7. The method of claim 6, wherein the oil is mixed with sulfite liquor.

8. The method of claim 7, wherein the oil is mixed with sulfite liquor of a concentration of about 20 to 70 percent.

* * * * *